US005726354A

United States Patent [19]

Nomura et al.

[11] Patent Number: 5,726,354

[45] Date of Patent: Mar. 10, 1998

[54] TESTING METHOD FOR FUEL VAPOR TREATING APPARATUS

[75] Inventors: Tokuhisa Nomura, Toyota; Hironori Miyakoshi, Seto, both of Japan

[73] Assignee: Toyota Jidosha Kabushiki Kaisha, Toyota, Japan

[21] Appl. No.: 688,471

[22] Filed: Jul. 30, 1996

[30] Foreign Application Priority Data

Jul. 31, 1995 [JP] Japan ..... 7-195165

[51] Int. Cl.[6] ..... F02M 25/08; F02D 41/22

[52] U.S. Cl. ..... 73/118.1; 73/49.7

[58] Field of Search ..... 73/49.7, 47, 40.5 R, 73/116, 117.2, 117.3, 118.1; 123/519, 520

[56] References Cited

U.S. PATENT DOCUMENTS

| | | | |
|---|---|---|---|
| 5,143,035 | 9/1992 | Kayanuma | 123/198 |
| 5,158,054 | 10/1992 | Otsuka | 123/198 |
| 5,245,973 | 9/1993 | Otsuka et al. | 123/518 |
| 5,295,472 | 3/1994 | Otsuka et al. | 123/520 |
| 5,315,980 | 5/1994 | Otsuka et al. | 123/520 |
| 5,333,589 | 8/1994 | Otsuka | 123/520 |
| 5,373,823 | 12/1994 | Kuroda et al. | 123/520 |
| 5,398,661 | 3/1995 | Denz et al. | 123/520 |
| 5,425,344 | 6/1995 | Otsuka et al. | 123/520 |
| 5,443,051 | 8/1995 | Otsuka | 123/520 |
| 5,483,942 | 1/1996 | Perry et al. | 123/520 |
| 5,495,749 | 3/1996 | Dawson et al. | 73/47 |
| 5,560,243 | 10/1996 | Wild | 73/49.7 |
| 5,590,634 | 1/1997 | Shinohara | 123/520 |

FOREIGN PATENT DOCUMENTS

| | | |
|---|---|---|
| 3249364A | 11/1991 | Japan . |
| 5195895A | 8/1993 | Japan . |

OTHER PUBLICATIONS

Office Action for U.S. Application Serial No. 08/617,252, filed Mar. 18, 1996.

*Primary Examiner*—George M. Dombroske
*Attorney, Agent, or Firm*—Kenyon & Kenyon

[57] ABSTRACT

A fuel vapor treating apparatus that collects fuel vapor produced in a fuel tank and treats the vapor without releasing it into the atmosphere. The treating apparatus is provided with a canister that collects the fuel vapor through a vapor line. A vapor control valve provided in the canister adjusts the flow of fuel vapor directed toward the canister from the tank. A purge line connects the canister to an air intake passage of an engine. The fuel collected in the canister is purged into the air intake passage through the purge line. A purge control valve provided in the purge line adjusts the flow rate of the fuel flowing through the purge line. A three-way valve selectively switches the section to which the pressure sensor is connected between the tank side and the canister side. An electronic control unit (ECU) controls the second control valve and the three-way valve. The ECU tests the sealing of the tank side and the canister side based on the tank pressure and the canister pressure, which are detected by the pressure sensor. The ECU controls the three-way valve to alternately connect the pressure sensor to the tank side and the canister side during a predetermined time period subsequent to the starting of the engine. As the connection is switched, alteration in the output occurs in accordance with the normal state or abnormal state of the connected side. The ECU further tests the pressure sensor by distinguishing the output alteration.

17 Claims, 7 Drawing Sheets

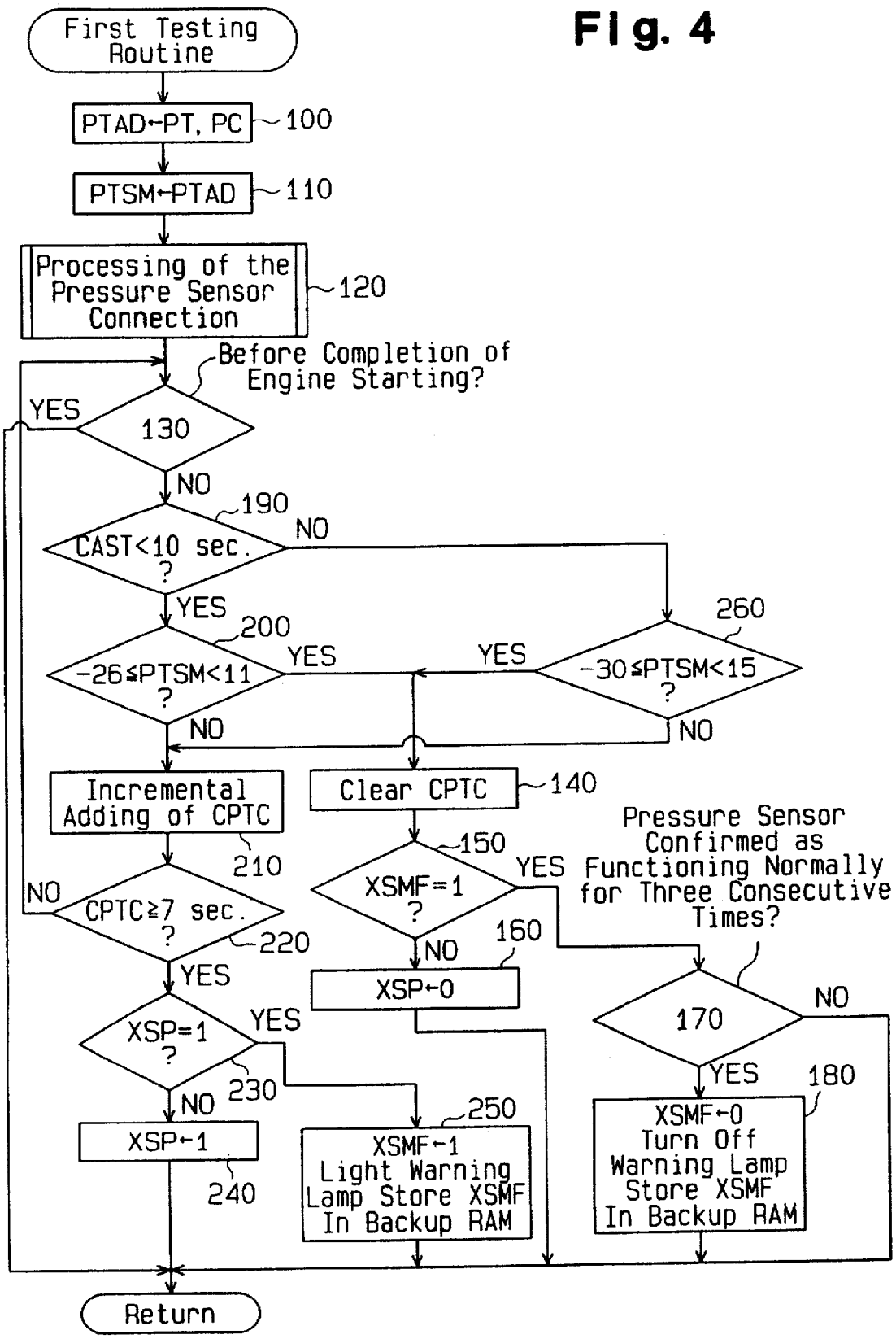
Fig. 4
First Testing Routine
PTAD←PT, PC
100
PTSM←PTAD
110
Processing of the Pressure Sensor Connection
120
Before Completion of Engine Starting?
130
YES
NO
190
CAST<10 sec. ?
NO
YES
200
-26≤PTSM<11 ?
YES
YES
260
-30≤PTSM<15 ?
NO
NO
Incremental Adding of CPTC
210
Clear CPTC
140
150
XSMF=1 ?
YES
Pressure Sensor Confirmed as Functioning Normally for Three Consecutive Times?
NO
CPTC≥7 sec. ?
220
NO
160
XSP←0
YES
XSP=1 ?
YES
230
170
NO
YES
180
NO
XSP←1
240
250
XSMF←1 Light Warning Lamp Store XSMF In Backup RAM
XSMF←0 Turn Off Warning Lamp Store XSMF In Backup RAM
Return

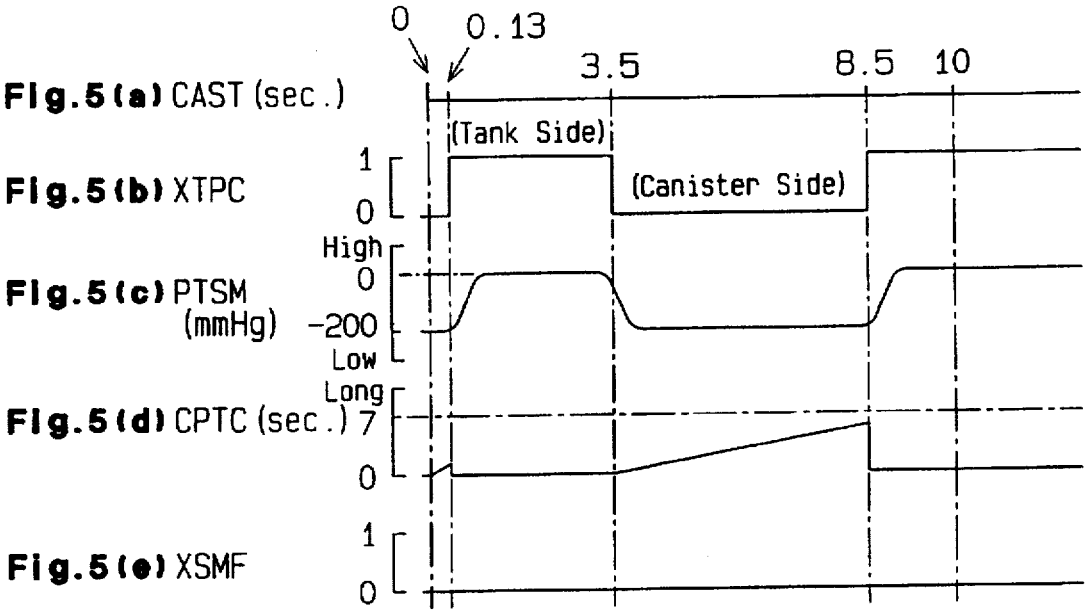
0
0.13
3.5
8.5
10
Fig.5(a) CAST (sec.)
(Tank Side)
(Canister Side)
Fig.5(b) XTPC
1
0
High
Fig.5(c) PTSM (mmHg)
0
-200
Low
Long
Fig.5(d) CPTC (sec.)
7
0
Fig.5(e) XSMF
1
0
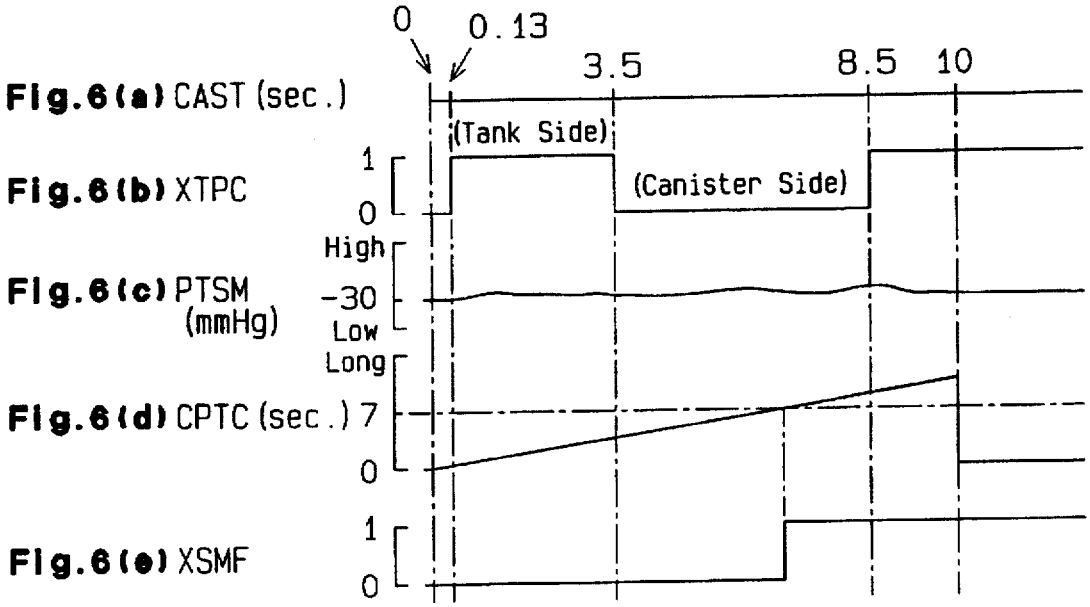
0
0.13
3.5
8.5
10
Fig.6(a) CAST (sec.)
(Tank Side)
(Canister Side)
Fig.6(b) XTPC
1
0
High
Fig.6(c) PTSM (mmHg)
-30
Low
Long
Fig.6(d) CPTC (sec.)
7
0
Fig.6(e) XSMF
1
0

TESTING METHOD FOR FUEL VAPOR TREATING APPARATUS

BACKGROUND OF THE INVENTION

1. Field of the Invention

The present invention relates generally to an apparatus for collecting and treating vaporized fuel in a fuel tank without releasing the fuel vapor into the atmosphere. More particularly, the present invention pertains to a method for finding malfunctions concerning the sealing of a fuel vapor treating apparatus, which is provided with a canister for collection of fuel and a purging means for appropriate purging of the fuel into an intake passage of an engine.

2. Description of the Related Art

A fuel vapor treating apparatus, typically mounted on a vehicle, collects and treats vaporized fuel in a fuel tank without releasing the fuel vapor into the atmosphere. As shown in FIG. 8, a typical apparatus has a canister 73 that draws in and collects fuel vaporized in a fuel tank 71 through a vapor line 72. The canister 73 is filled with an adsorbent 74 comprised of activated carbon or the like. A purge line 75, extending from the canister 73, is connected to an intake passage 77 of an engine 76. The adsorbent 74 in the canister 73 first adsorbs the vaporized fuel drawn in through the vapor line 72. The canister 73 collects fuel and discharges only the residual gas, from which fuel components (particularly hydrocarbon, HC) have been extracted, into the atmosphere through a hole 78. The fuel collected in the canister 73 is purged into the intake passage 77 by way of the purge line 75 during operation of the engine 76. A purge control valve 79, provided in the purge line 75, adjusts the flow rate of the fuel conveyed through the purge line 75 in accordance with the requirements of the engine 76.

In this typical treating apparatus, damage or disconnection of the vapor line 72 may lead to a degradation in the airtightness, or sealing, of the treating apparatus. This may result in insufficient treatment of the vaporized fuel.

Japanese Unexamined Patent Publication 6-108930 describes an apparatus that determines malfunctions such as those described above. As shown in FIG. 9, a testing apparatus used for fuel vapor treating apparatuses includes a fuel tank 81, a canister 82, a vapor line 83, and a purge line 84. A purge vacuum switching valve (VSV), or purge control valve 85, provided in the purge line 84, adjusts the flow rate of the fuel passing through the line 84. An electronic control unit (ECU) 86 controls the purge control valve 85 during operation of the engine 76. A vapor control valve 87, provided in the vapor line 83, controls the flow of vaporized fuel directed toward the canister 82 from the fuel tank 81. A difference in the pressure at the fuel tank 81 side of the vapor control valve 87 and the pressure at the canister 82 side of the valve 87 opens the valve 87 and causes the vaporized fuel to flow therethrough toward the canister 82. The testing apparatus includes a pressure sensor 88 which separately detects the pressure in the tank side of the vapor control valve 87 and the canister side of the valve 87. That is, a three-way valve 89, connected to the pressure sensor 88, includes a port connected to the vapor line 83 at the side of the fuel tank 81 and another port connected to the vapor line 83 at the side of the canister 82. The pressure sensor 88 selectively detects the tank pressure and the canister pressure when the ECU 86 switches the side which the three-way valve 89 is connected to in accordance with its requirements. The ECU 86 determines whether there is a malfunction in either the tank side or the canister side based on the detected value of the tank pressure and the canister pressure.

A relative pressure sensor that detects relative pressure may be employed as the pressure sensor 88 of the testing apparatus described in the above apparatus. In such cases, the output dynamic range of the relative pressure sensor may be too narrow when used to test the fuel vapor treating apparatus. Thus, an appropriate reading corresponding to the pressure fluctuation in the treating apparatus may not be obtained when using only the relative pressure sensor. This may result in the ECU 86 performing an erroneous determination of the treating apparatus.

For example, there is a possibility that the ECU 86 will not appropriately test the treating apparatus when the pressure fluctuation in the treating apparatus temporarily exceeds a certain range. This is due to the relative pressure sensor being unable to transmit a value according to the level of fluctuating pressure. As another example, a short circuit or disconnection in the relative pressure sensor may cause the output value of the sensor to become smaller or larger than the actual value. In such cases, the ECU 86 is not capable of determining whether the output value is the result of a malfunction in the relative pressure sensor or whether it is the result of a pressure fluctuation in the treating apparatus.

SUMMARY OF THE INVENTION

Accordingly, it is a primary objective of the present invention to provide a testing method for a fuel vapor treating apparatus capable of appropriately testing a relative pressure detecting means.

To achieve the above and other objects and in accordance with the purpose of the present invention, a testing method for a fuel vapor treating apparatus is provided. The treating apparatus includes a canister for collecting fuel vapor generated in a fuel tank through a vapor line, wherein the fuel in the tank is supplied to an engine. The treating apparatus includes a purge line for purging the collected fuel in the canister into an air intake passage of the engine by a negative intake pressure generated in the intake passage during operation of the engine. The treating apparatus includes a vapor control valve connected to the vapor line between the tank and the canister for adjusting a flow of the fuel vapor passing from the tank to the canister, wherein the vapor control valve opens in accordance with a difference between the pressure of the tank and the pressure of the canister. The method comprises selectively detecting the pressure at a tank side of the vapor control valve and the pressure at a canister side of the vapor control valve by using pressure detecting means. The method comprises judging whether a malfunction has occurred related to a sealing of the tank side or related to a sealing of the canister side based on the detected pressure of the tank side and the detected pressure of the canister side. The method comprises alternately detecting the pressure of the tank side and the pressure of the canister side during a predetermined time period subsequent to a starting of the engine. The method comprises judging whether a malfunction of the pressure detecting means has occurred based on the detected pressures.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 4 shows a flow chart illustrating a "first testing routine";

FIGS. 5(*a*) to 5(*e*) show time charts illustrating the behavior of various parameters;

FIGS. 6(*a*) to 6(*e*) show time charts illustrating the behavior of various parameters;

DETAILED DESCRIPTION OF THE PREFERRED EMBODIMENT

A testing method for a vehicle fuel vapor treating apparatus according to the present invention will hereafter be described with reference to the drawings.

Figure 1:
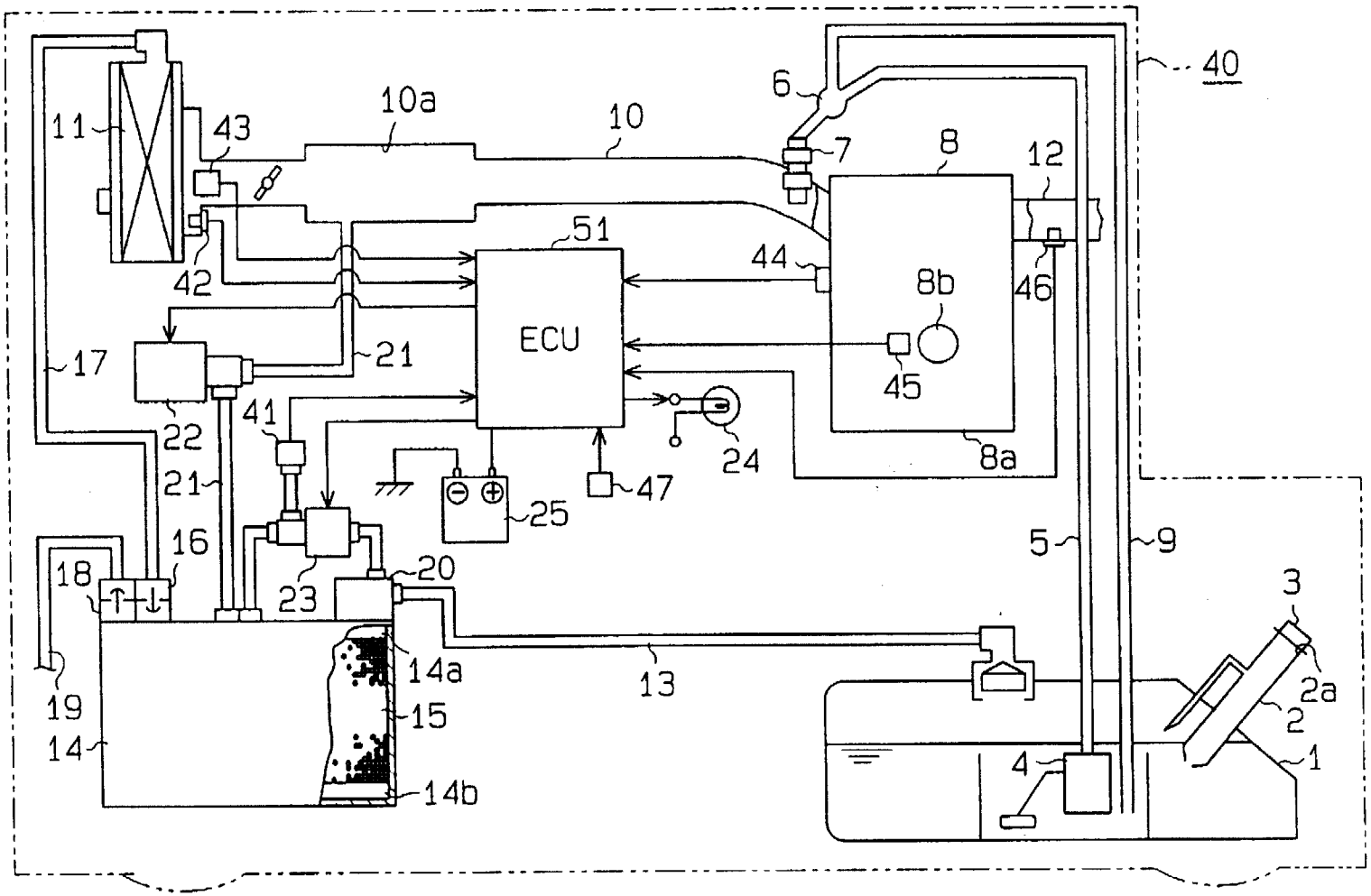
FIG. 1 is a schematic view showing a fuel vapor treating apparatus and its testing apparatus.

FIG. 1 shows a schematic view of a fuel vapor treating apparatus and its testing apparatus. A gasoline engine system of a vehicle 40 has a fuel tank 1 in which fuel is reserved. The tank 1 includes a filler pipe 2 to charge fuel, or refuel the tank 1. The pipe 2 has a filler hole 2*a* into which a fuel nozzle (not shown) is inserted during refueling of the tank 1. The filler hole 2*a* is closed by a removable cap 3.

The fuel inside the tank 1 is drawn into a pump 4, incorporated in the tank 1, and discharged therefrom. A main line 5 extending from the pump 4 is connected to a delivery pipe 6. A plurality of injectors 7, provided in the pipe 6, are aligned with cylinders (not shown) of an engine 8. A return line 9 extending from the pipe 6 is connected to the tank 1. Operation of the pump 4 causes the fuel discharged from the pump 4 to be sent to the delivery pipe 6 via the main line 5. The delivery pipe 6 distributes the fuel to each injector 7. As each injector 7 is actuated, the fuel is injected into an intake passage 10. The intake passage 10 includes an air cleaner 11 and a surge tank 10*a*. Air is drawn into the intake passage 10 after being purified by the air cleaner 11. The fuel, injected from the injectors 7, is mixed with the air and supplied to each cylinder of the engine 8 for combustion. The residual fuel that is not distributed to the injectors 7 is returned to the tank 1 via the return line 9. The exhaust gas produced during combustion is emitted into the atmosphere from the cylinders of the engine 8 through an exhaust passage 12.

The fuel vapor treating apparatus of the preferred embodiment collects and treats vaporized fuel produced in the tank 1 without releasing the fuel into the atmosphere. The fuel vapor treating apparatus has a canister 14 to collect vaporized fuel flowing through the vapor line 13. The canister 14 is filled with an adsorbent 15 comprised of activated carbon or the like. The canister 14 includes an accommodating space, in which the adsorbent 15 is located, and opened spaces 14*a*, 14*b*, defined above and below the adsorbent 15.

A first control valve 16, which is a check valve, is provided in the canister 14. The control valve 16 opens when the interior pressure of the canister 14 becomes smaller than the atmospheric pressure. When opened, the control valve 16 allows atmospheric air to be drawn into the canister 14 while preventing a flow of gas in the reverse direction. An air pipe 17 extending from the control valve 16 is connected to a position near the air cleaner 11. This structure enables atmospheric air, purified by the air cleaner 11, to be drawn into the canister 14. The canister 14 is also provided with a second control valve 18, which is also a check valve. The control valve 18 opens when the interior pressure of the canister 14 becomes greater than the atmospheric pressure. When opened, the control valve 18 allows gas (internal pressure) to be released from the canister 14 through an outlet pipe 19 while preventing a reversed flow of the gas.

A vapor control valve 20, provided in the canister 14, controls the flow rate of the vaporized fuel passing therethrough from the tank 1 to the canister 14. The control valve 20 opens in accordance with the difference between the interior pressure PT at the side of the tank 1 including the vapor line 13 (hereafter referred to as tank pressure) and the interior pressure PC at the side of the canister 14 (hereafter referred to as canister pressure). When opened, the control valve 20 allows vaporized fuel to flow into the canister 14 from the tank 1. In other words, the control valve 20 opens and allows vaporized fuel to enter the canister 14 when the value of the canister pressure PC becomes approximately the same as the atmospheric pressure and thus becomes smaller than the tank pressure PT. The control valve 20 also allows gas to flow toward the tank 1 from the canister 14 when the canister pressure PC becomes higher than the tank pressure PT.

A purge line 21, extending from the canister 14, is connected to the surge tank 10*a*. The canister 14 collects fuel introduced through the vapor line 13 and discharges only the residual gas, from which fuel components have been extracted, into the atmosphere through the outlet pipe 19 when the control valve 18 is opened. When the engine 8 is running, the negative pressure produced in the intake passage 10 acts on the purge line 21. This causes the fuel collected in the canister 14 to be purged into the intake passage 10 through the purge line 21. A purge control valve 22, provided in the purge line 21, adjusts the flow rate of fuel passing through the line 21 when required by the engine 8. The control valve 22 is an electromagnetic valve that includes a casing and a valve body (neither is shown). The valve body is moved by an electric signal (duty signal) to open the control valve 22. The opening of the control valve 22 is duty controlled.

Duty control refers to the controlling of the energized time period based on a duty ratio. The duty ratio is obtained from the ratio of the energized time period with respect to the time period of a single cycle. Furthermore, the average electric current is variably controlled by digitally altering the ratio of the energized time period with respect to the non-energized time period. In this embodiment, duty control particularly refers to intermittent opening of the control valve 22 based on the duty ratio.

Figure 3:
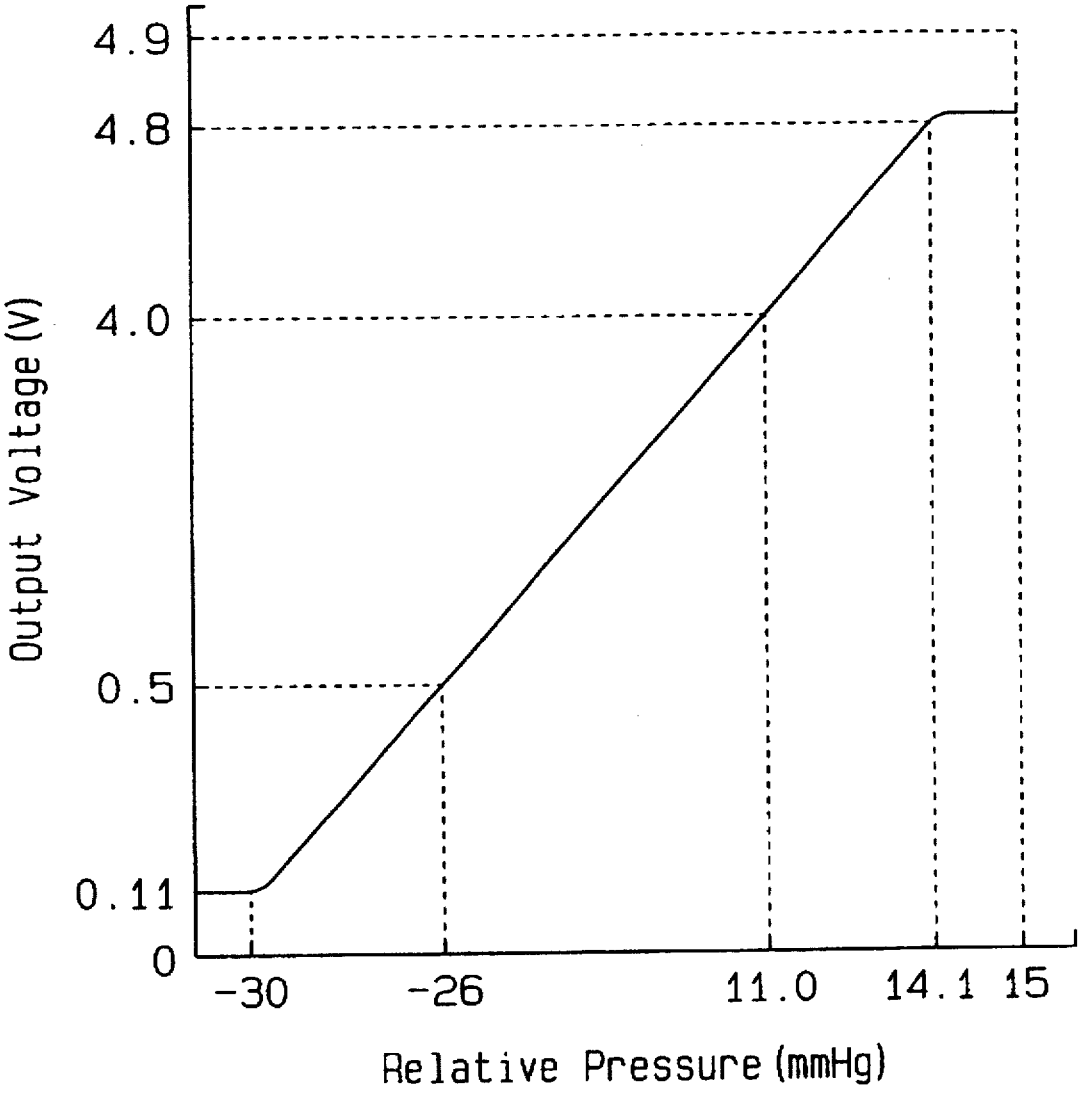
FIG. 3 shows a graph illustrating the relationship between pressure and voltage in a pressure sensor.

The testing apparatus, which tests the sealing of the treating apparatus, includes a pressure sensor 41. The pressure sensor 41 detects relative pressure within a predetermined range, which is based on the atmospheric pressure. The pressure sensor 41 then emits an analog signal corresponding to the detected value within a predetermined dynamic range. The pressure-voltage relationship of the pressure sensor 41 is illustrated in a graph in FIG. 3. As shown in the graph, the pressure sensor 41 is capable of detecting pressure within the range of minus 30 mmHg to 15 mmHg. The pressure sensor 41 also produces voltage proportional to the detected pressure within the range of 0.11 V to 4.8 V. When the pressure becomes lower than minus 30 mmHg, the output voltage becomes constant at 0.11 V. When the pressure becomes equal to or greater than 15 mmHg, the output voltage becomes constant at 4.8 V.

The pressure sensor 41 is capable of separately detecting the tank pressure PT and the canister pressure PC. A three-way valve 23 having three ports is provided with the pressure sensor 41. The three-way valve 23 electrically connects two of the three ports together based on electric signals. A first port of the three-way valve 23 is connected to the sensor 41. A second port is connected to the vapor line 13 at the tank 1 side of the control valve 20. A third port is connected to the canister 14. By switching the connected pair of ports of the three-way valve 23 when required, the pressure sensor 41 becomes selectively connected with either the vapor line 13 or the canister 14. The switching enables the pressure sensor 41 to selectively detect either the tank pressure PT or the canister pressure PC. In this embodiment, priority is given to the detection of the tank pressure PT. Thus, the three-way valve 23 is set to be connected to the vapor line 13 in case it cannot be switched by electric signals.

Various sensors 42, 43, 44, 45, 46, 47 detect the running condition of the engine 8 and the vehicle 40. The intake air temperature sensor 42, which is located near the air cleaner 11, detects the temperature of the air drawn into the intake passage 10, or the intake air temperature THA, and transmits a signal based on the detected temperature value. The intake flow rate sensor 43, located near the air cleaner 11, detects the intake flow rate Q of the air drawn into the intake passage 10 and transmits a signal based on the detected flow rate. The coolant temperature sensor 44, provided on the engine 8, detects the temperature of the coolant flowing through an engine block 8*a*, or the coolant temperature THW, and transmits a signal based on the detected temperature value. The engine speed sensor 45, provided in the engine 8, detects the revolution speed of a crank shaft 8*b*, or the engine speed NE, and transmits a signal based on the detected speed. The oxygen sensor 46, provided in the exhaust passage 12, detects the oxygen concentration Ox of the exhaust gas passing through the exhaust passage 12 and transmits a signal based on the detected value. The vehicle speed sensor 47, provided in the vehicle 40, detects the vehicle speed SPD and transmits a signal based on the detected speed.

An electronic control unit (ECU) 51 receives the signals transmitted from the sensors 41–47. The ECU 51 commands the treating apparatus and controls fuel purging. The ECU 51 controls the purge control valve 22 and purges fuel from the canister 14 to the intake passage 10 at a flow rate corresponding to the running condition of the engine 8. That is, the ECU 51 sends a duty signal to the purge control valve 22 that is necessary to control the opening of the valve 22 in correspondence with the required duty ratio DPG.

The fuel purged into the intake passage 10 from the canister 14 influences the air-fuel ratio in the engine 8. The influence on the air-fuel ratio is taken into consideration by the ECU 51 when determining the opening of the purge control valve 22 in accordance with the running condition of the engine 8. Generally, a high air-fuel ratio results in an increase in carbon monoxide (CO) concentration of the exhaust gas from an engine. Thus, the ECU 51 computes the purge concentration FGPG (the purge concentration FGPGI during idling of the engine 8) from the oxygen concentration Ox of the exhaust gas detected by the oxygen sensor 46. Based on the computed value, the ECU 51 determines the duty ratio DPG for the opening of the purge control valve 22, and transmits a duty signal in accordance with the value of the determined duty ratio DPG to the purge control valve 22.

The ECU 51 also commands the testing apparatus. In accordance with the results detected by the sensors 41–47, the ECU 51 switches the connected ports of the three-way valve 23 and selectively reads either the value of the tank pressure PT or the canister pressure PC, which are detected by the pressure sensor 41. The ECU 51 performs tests related to the sealing of the tank side and the sealing of the canister side based on the values of the tank pressure PT and the canister pressure PC.

In other words, when the pressure sensor 41 detects the tank pressure PT, the ECU 51 judges whether or not the detected value matches a predetermined value corresponding to the running condition of the engine 8. When the detected value matches the predetermined value, the ECU 51 determines that the tank side is in a normal state. When the detected value differs from the predetermined value, the ECU 51 determines that the tank side is malfunctioning. In the same manner, when the pressure sensor 41 detects the canister pressure PC, the ECU 51 judges whether or not the detected value matches a predetermined value corresponding to the running condition of the engine 8. When the detected value matches the predetermined value, the ECU 51 determines that the canister side is functioning normally. When the detected value differs from the predetermined value, the ECU 51 determines that there is a malfunction in the canister side.

The ECU 51 performs testing of the purge control valve 22, the three-way valve 23, and the pressure sensor 41 based on the values detected by the sensors 41–47. A warning lamp 24, arranged on an instrument panel in front of the driver's seat in the vehicle 40, informs the driver of the result of the tests performed by the ECU 51. The warning lamp 24 is lit when there is a malfunction in the treating apparatus or the testing apparatus. The lamp 24 remains turned off when the treating apparatus and the testing apparatus are in a normal state. The ECU 51 is energized by a battery 25 mounted in the vehicle 40 and concurrently judges the voltage state of the battery 25.

Figure 2:
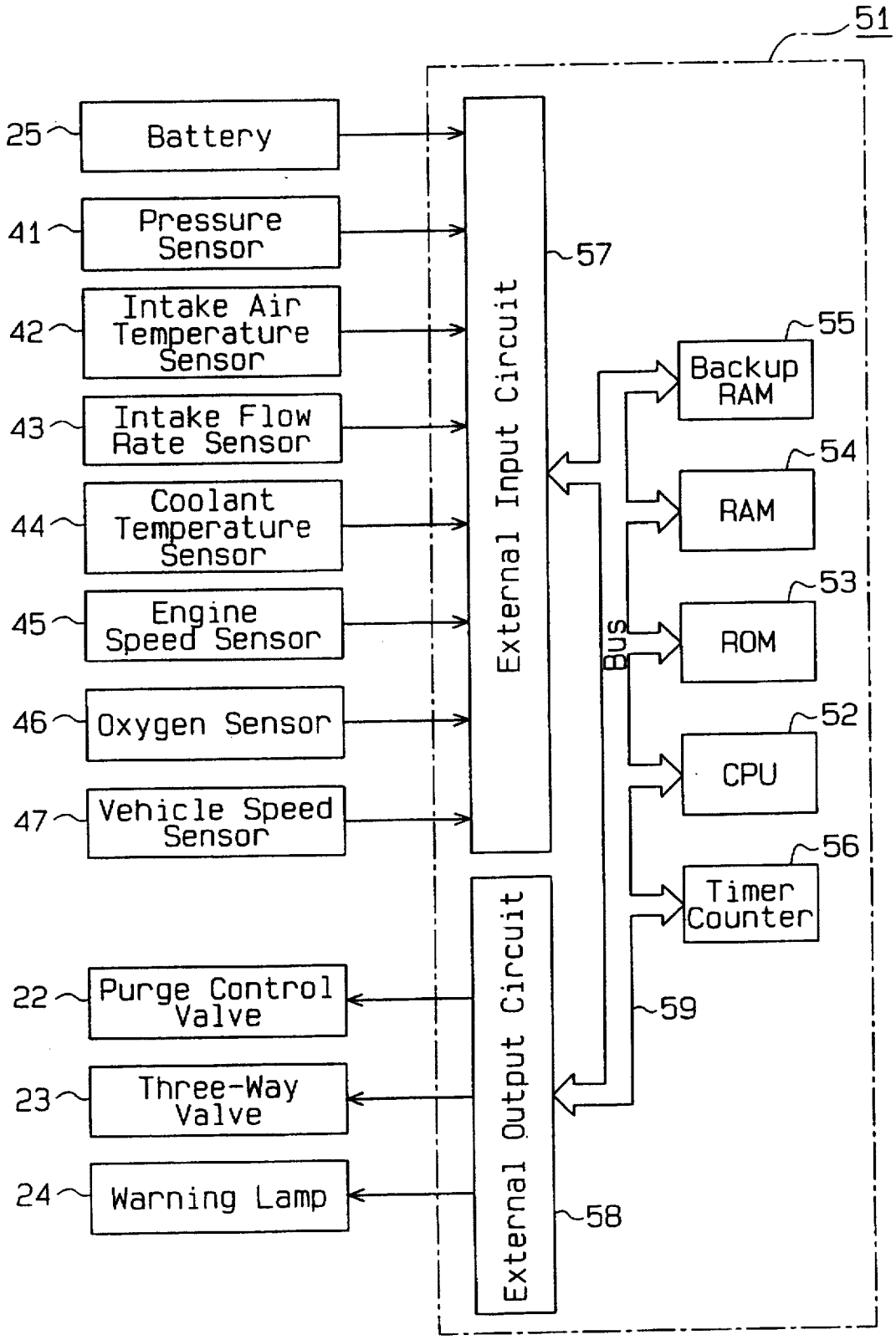
FIG. 2 shows a block diagram illustrating the structure of an ECU.

As shown in the block diagram of FIG. 2, the ECU 51 includes a central processing unit (CPU) 52, a read-only memory (ROM) 53, a random access memory (RAM) 54, a backup RAM 55, and a timer counter 56. In the ECU 51, a logical computing circuit is formed by the CPU 52, the ROM 53, the RAM 54, the backup RAM 55, the timer counter 56, an external input circuit 57, an external output circuit 58, and a bus 59, which connects these parts to one another. The ROM 53 prestores a predetermined program related to the fuel purging and malfunction tests. The RAM 54 temporarily stores the computed results of the CPU 52. The backup RAM 55 prestores data. The timer counter 56 simultaneously executes a plurality of time measurements. The external input circuit 57 includes a buffer, a waveform shaping circuit, a hard filter (a circuit having an electric resistor and a condenser), and an analog to digital (A/D) converter. The external output circuit 58 includes a drive circuit. The sensors 41–47 and the battery 25 are connected to the external input circuit 57. The pressure sensor 41 is connected to the hard filter. The hard filter is connected to the A/D converter. The purge control valve 22, the three-way valve 23, and the warning lamp 24 are connected to the external output circuit 58.

The detected signals of the sensors 41–47 and the voltage value VAE of the battery 25 sent via the external input circuit 57 are read by the CPU 52 as input values. The CPU 52 controls the control valve 22, the three-way valve 23, and the warning lamp 24 to perform fuel purging and testing based on the input values.

The processing performed by the ECU 51 will now be described. FIG. 4 illustrates a flowchart of a "first testing routine" through which the tests are performed. The ECU 51 periodically executes the routine for every predetermined time period. Control programs related to various routines are prestored in the ROM 53 of the ECU 51.

At steps 100, 110, the ECU 51 processes the values detected by the pressure sensor 41. The ECU 51 converts the analog signal from the pressure sensor 41 to a digital signal once every 65 milliseconds. That is, when the three-way valve 23 is not switched by the ECU 51, the pressure sensor 41 is connected to the vapor line 13 at the tank side. Accordingly, in step 100, the ECU 51 processes the tank pressure PT, detected by the pressure sensor 41, in the hard filter and stores the processed value PTAD in the RAM 54. By using the hard filter to process the value of the tank pressure PT, noise of the value detected by the pressure sensor 41 is eliminated.

When the ECU 51 switches the three-way valve 23, the pressure sensor 41 becomes connected to the canister side. Accordingly, in step 100, the ECU 51 processes the canister pressure PC, detected by the pressure sensor 41, in the hard filter and stores a processed value PTAD ("PTAD"0 is used commonly for both the tank pressure PT and the canister pressure PC) in the RAM 54. In the same manner as the detected value of the tank pressure PT, the usage of the hard filter to process the value of the canister pressure PC, eliminates noise of the value detected by the pressure sensor 41.

In step 110, the ECU 51 smoothens the processed value PTAD, or processes the processed value PTAD in a soft filter to obtain an average value, or smoothed value PTSM. The following equation (1) indicates how to compute the smoothed value PTSM.

$$PTSM=PTSMO+(PTAD-PTSMO)/KTIME \quad (1)$$

In this equation, KTIME represents the smoothening rate. KTME corresponds to a value in the range of 4 to 16. PTSMO represents the previously computed smoothed value. The ECU 51 obtains the smoothed value PTSM once every 65 milliseconds. The ECU 51 sets the processed value PTAD, which is the first value output from the pressure sensor 41 when the engine 8 is started, as the initial smoothed value PTSM. Afterwards, the ECU 51 recomputes the smoothed value PTSM once every 65 milliseconds.

The ECU 51 stores the smoothed value PTSM in the RAM 54. The ECU 51 stores the smoothed value PTSM related to the tank pressure PT and the smoothed value PTSM related to the canister pressure PC in the RAM 54. By using the soft filter to process the processed value PTAD, pulsation of the detected value of the pressure sensor 41, caused when time elapses, is eliminated.

At step 120, the ECU 51 controls the three-way valve 23 to connect the pressure sensor 41 to either the tank side or the canister side. More specifically, the ECU 51 uses another routine to measure a running time CAST, which is timed from when the engine 8 is started. When the running time CAST is in the range of zero seconds to 0.13 seconds, the ECU 51 controls the three-way valve 23 to connect the pressure sensor 41 to the canister side. When the running time CAST is in the range of 0.13 seconds to 3.5 seconds, the ECU 51 controls the three-way valve 23 to connect the pressure sensor 41 to the tank side. When the running time CAST is in the range of 3.5 seconds to 8.5 seconds, the ECU 51 controls the three-way valve 23 to connect the pressure sensor 41 to the canister side. After the running time CAST becomes longer than 8.5 seconds, the ECU 51 controls the three-way valve 23 to connect the pressure sensor 41 to the tank side. When the ECU 51 switches the connected ports in the three-way valve 23, a switching flag XTPC is changed to indicate where the pressure sensor 41 is connected to. That is, the switching flag XTPC is set at one when the ECU 51 connects the pressure sensor 41 to the tank side. The switching flag XTPC is set at zero when the pressure sensor 41 is connected to the canister side.

At step 130, the ECU 51 judges whether starting of the engine 8 has been completed. This is carried out by confirming whether the value detected by the engine speed sensor 45 is lower than a predetermined value (e.g., 450 rpm). If the starting of the engine 8 has not yet been completed, the ECU 51 temporarily terminates subsequent processing. If the starting of the engine 8 has been completed, the ECU 51 proceeds to step 190.

After the starting of the engine 8 is completed, in step 190, the ECU 51 judges whether the running time CAST is shorter than ten seconds. The criterion of ten seconds is an exemplary value. If the running time CAST is shorter than ten seconds, indicating that sufficient length of time has not elapsed since completing the starting of the engine 8, the ECU 51 proceeds to step 200. If the running time CAST is equal to or longer than ten seconds, indicating that a sufficient length of time has elapsed since completing the starting of the engine 8, the ECU 51 proceeds to step 260.

At step 200, the ECU 51 judges whether the smoothed value PTSM is within the range starting from a value equal to minus 26 mmHg to a value lower than 11 mmHg. This range corresponds to a range of the output voltage of the pressure sensor 41 starting from a value equal to 0.5 V to a value lower than 4.0 V. The range of minus 26 mmHg to 11 mmHg is an exemplary range. This range is the range that ensures that the pressure sensor 41 is functioning properly before ten seconds elapses subsequent to the completion of the starting of the engine 8. Thus, there is a possibility that the pressure sensor 41 is malfunctioning when the smoothed value PTSM is not in this range. If not in this range, the ECU 51 proceeds to step 210 and incrementally adds the after-judgement time CPTC. If the smoothed value PTSM is included in this range, the ECU 51 determines that the pressure sensor 41 is functioning normally and proceeds to step 140 from step 200.

When the ECU 51 proceeds to step 260 from step 190, the ECU 51 judges whether the smoothed value PTSM is within the range starting from a value equal to minus 30 mmHg to a value lower than 15 mmHg. This range corresponds to a range of the output voltage of the pressure sensor 41 starting from a value equal to 0.11 V to a value lower than 4.8 V. The range of minus 30 mmHg to 15 mmHg is an exemplary range. This range is the range which ensures that the pressure sensor 41 is functioning properly after ten seconds elapses subsequent to the completion of the starting of the engine 8. Thus, there is a possibility that the pressure sensor 41 is malfunctioning when the smoothed value PTSM is not in this range. If not in this range, the ECU 51 proceeds to step 210. If the smoothed value PTSM is included in this range, the ECU 51 determines that the pressure sensor 41 is functioning normally and proceeds to step 140 from step 260.

From step 210, the ECU 51 proceeds to step 220 and judges whether the after-judgement time CPTC is equal to or longer than seven seconds. Seven seconds is an exemplary value. Seven seconds is the optimum value for tentative judgement of malfunctions in the pressure sensor 41. If the after-judgement time CPTC is shorter than seven seconds, the ECU 51 proceeds to step 130. If the after-judgement time CPTC is equal to or longer than 7 seconds, there is a great possibility that the pressure sensor 41 is malfunctioning. In such case, the ECU 51 assumptively determines that the pressure sensor 41 is malfunctioning and proceeds to step 230.

At step 230, the ECU 51 judges whether the tentative malfunction flag XSP is set at 1. If the flag XSP is set at zero, the ECU 51 proceeds to step 240 and changes the flag XSP to one. The ECU 51 then temporarily terminates subsequent processing. When the flag XSP is determined to be set at one in step 230, this indicates that the conditions causing the flag XSP to be set to one has been confirmed for two consecutive times. This ensures that the pressure sensor 41 is malfunctioning. In this case, the ECU 51 proceeds to step 250 and sets the malfunction flag XSMF to one and lights the warning lamp 24. The value of the malfunction flag XSMF is stored in the backup RAM 55 as test data. The ECU 51 then temporarily terminates subsequent processing.

From step 200 or step 260, the ECU 51 proceeds to step 140 and clears the value of an after-judgement time CPTC setting it to zero and then proceeds to step 150.

Afterwards, in step 150, the ECU 51 judges whether a malfunction flag XSMF, which indicates malfunctions of the pressure sensor 41, is set at 1. The malfunction flag XSMF is set at either one or zero in correspondence with certain conditions being satisfied. If the flag XSMF is set at zero, the ECU 51 determines that the pressure sensor 41 is free of malfunctions and proceeds to step 160. At step 160, the ECU 51 sets a tentative malfunction flag XSP to zero and then temporarily terminates subsequent processing.

Therefore, the after-judgement time CPTC is cleared to zero and the tentative malfunction flag XSP is set to zero before completing the starting of the engine 8 when it is determined that there are no malfunctions of the pressure sensor 41.

If the malfunction flag XSMF is confirmed to be set at one in step 150, the ECU 51 proceeds to step 170. At step 170, the ECU 51 determines whether the pressure sensor 41 has been confirmed as functioning normally for three consecutive times in either steps 200 or 260. When the pressure sensor 41 has been confirmed as functioning normally for three consecutive times, the ECU 51 determines that pressure sensor 41, which was malfunctioning temporarily, is now functioning normally. The ECU 51 than proceeds to step 180. At step 180, the ECU 51 sets the malfunction flag XSMF to zero and turns off the warning lamp 24. Furthermore, the value of the malfunction flag XSMF is stored in the backup RAM 55 as testing data. The ECU 51 then temporarily terminates subsequent processing. If the confirmation of the pressure sensor 41 functioning normally is not repeated for three consecutive times, the ECU 51 determines that the pressure sensor 41 is still malfunctioning. The ECU 51 then temporarily terminates subsequent processing. The "first testing routine" is carried out in the above manner.

The above routine is logically constructed under the assumption that it is impossible for both the tank side and the canister side to be malfunctioning in which case the tank side pressure and the canister side pressure would both indicate abnormal values.

The behavior of various parameters during the above routine will hereafter be described with reference to FIGS. 5(*a*) to 5(*e*) and FIGS. 6(*a*) to 6(*e*). FIGS. 5(*a*) to 5(*e*) show the behavior of various parameters when the pressure sensor 41 is functioning properly while there is a malfunction in the canister side.

When the engine 8 is started (CAST=0), the smoothed value PTSM at the canister side is minus 200 mmHg indicating that there is an abnormality. This initiates the incremental adding of the after-judgement time CPTC.

After 0.13 seconds elapses subsequent to the starting of the engine 8 (CAST=0.13), the pressure sensor 41, which had been connected to the canister side, is connected to the tank side and the switching flag XTPC is changed to one. In this state, the smoothed value PTSM at the tank side is zero mmHg indicating that there are no malfunctions. Thus, the after-judgement time CPTC is cleared to zero.

Then, after 3.5 seconds elapses subsequent to the starting of the engine 8 (CAST=3.5), the pressure sensor 41, which had been connected to the tank side, is reconnected to the canister side and the switching flag XTPC is changed to zero. In this state, the smoothed value PTSM at the canister side is still minus 200 mmHg indicating that there is an abnormality. Thus, the incremental adding of the after-judgement time CPTC is commenced again.

After 8.5 seconds elapses subsequent to the starting of the engine 8 (CAST=8.5), the pressure sensor 41, which had been connected to the canister side, is reconnected to the tank side and the switching flag XTPC is changed to one. The after-judgement time CPTC is also cleared to zero. At this point of time, since the after-judgement time CPTC has not yet reached 7 seconds, the pressure sensor 41 is judged as being free of malfunctions. Thus, the malfunction flag XSMF is not changed to one.

The ECU 51 performs a test of the canister side for malfunctions related to its sealing by comparing the abnormal smoothed value PTSM with the predetermined reference range.

FIGS. 6(*a*) to 6(*e*) show the behavior of various parameters when the pressure sensor 41 is malfunctioning due to a short circuit or disconnection.

When the engine 8 is started (CAST=0), the smoothed value PTSM at the canister side is minus 30 mmHg indicating that there is an abnormality. This initiates the incremental adding of the after-judgement time CPTC.

After 0.13 seconds elapses subsequent to the starting of the engine 8 (CAST=0.13), the pressure sensor 41, which had been connected to the canister side, is connected to the tank side and the switching flag XTPC is changed to one. In this state, the smoothed value PTSM at the tank side is still minus 30 mmHg indicating an abnormality. Thus, the incremental adding of the after-judgement time CPTC is continued without being cleared.

Then, after 3.5 seconds elapses subsequent to the starting of the engine 8 (CAST=3.5), the pressure sensor 41, which had been connected to the tank side, is reconnected to the canister side and the switching flag XTPC is changed to zero. In this state, the smoothed value PTSM at the canister side is still minus 30 mmHg indicating an abnormality. Thus, the incremental adding of the after-judgement time CPTC is continued.

The pressure sensor 41 is judged as malfunctioning when the after-judgement time CPCT reaches seven seconds before 8.5 seconds elapses after the engine 8 is started. This changes the malfunction flag XSMF to one.

After 8.5 seconds elapses subsequent to the starting of the engine 8 (CAST=8.5), the pressure sensor 41, which had been connected to the canister side, is reconnected to the tank side. After 10 seconds elapses subsequent to the starting of the engine 8 (CAST=10), the smoothed value PTSM at this point of time indicates a value that shows the pressure sensor 41 functioning properly. Thus, the after-judgement time CPTC is cleared to zero at this point.

The ECU 51 performs a test of the canister side for malfunctions related to its sealing by comparing the smoothed value PTSM of minus 30 mmHg with the predetermined reference range. This prevents erroneous testing of the tank side and the canister side. As described above, it is possible to appropriately judge the pressure sensor 41 independently.

According to the preferred embodiment, during the period starting from when the engine 8 is started to when ten second elapses, the section detected by the pressure sensor 41 is switched repetitively with predetermined intervals between each switching. That is, the pressure switch 41 is first connected to the canister side, then to the tank side, then back to the canister side, and subsequently to the tank side again.

When the pressure sensor 41 is functioning normally and there are no malfunctions related to the sealing of the tank side and the canister side, the pressure sensor 41 alternately detects normal pressure values of the tank side and the canister side. When the pressure sensor 41 is functioning normally but there is a malfunction related to the sealing of either the tank side or the canister side, the pressure sensor 41 intermittently detects an abnormal pressure value indicating a malfunction in either the tank side or the canister side. If the pressure sensor 41 is malfunctioning, a pressure value indicating the malfunction is obtained continuously regardless of the relative pressure detecting means being alternately connected to different sides. Thus, a change takes place in the output pressure detected by the pressure sensor 41 when changing the side to which it is connected according to the predetermined order and interval. By distinguishing the alteration in the output value, malfunctions related to the sealing of the tank side and the canister side, and malfunctions of the pressure sensor 41 are each judged separately. This enables a test of the pressure sensor 41 to be performed separately from the test of the fuel vapor treating apparatus.

In this preferred embodiment, since the test of the pressure sensor 41 is performed independently, a special clamp circuit is not required to fix the output value in case the pressure sensor 41 malfunctions. This enables simplification of the pressure sensor 41 circuitry.

The warning lamp 24 provided near the driver's seat is lit when the pressure sensor 41 is judged as having a malfunction. This informs the driver of the malfunction and enables the malfunction to be coped with at an early stage.

When the pressure sensor 41 is judged as malfunctioning, the value of the malfunction flag XSMF is stored in the backup RAM 55 as testing data. Thus, by reading out the testing data from the RAM 55 during maintenance of the vehicle, it is possible to confirm the history of malfunctions in the pressure sensor 41.

Figure 7:
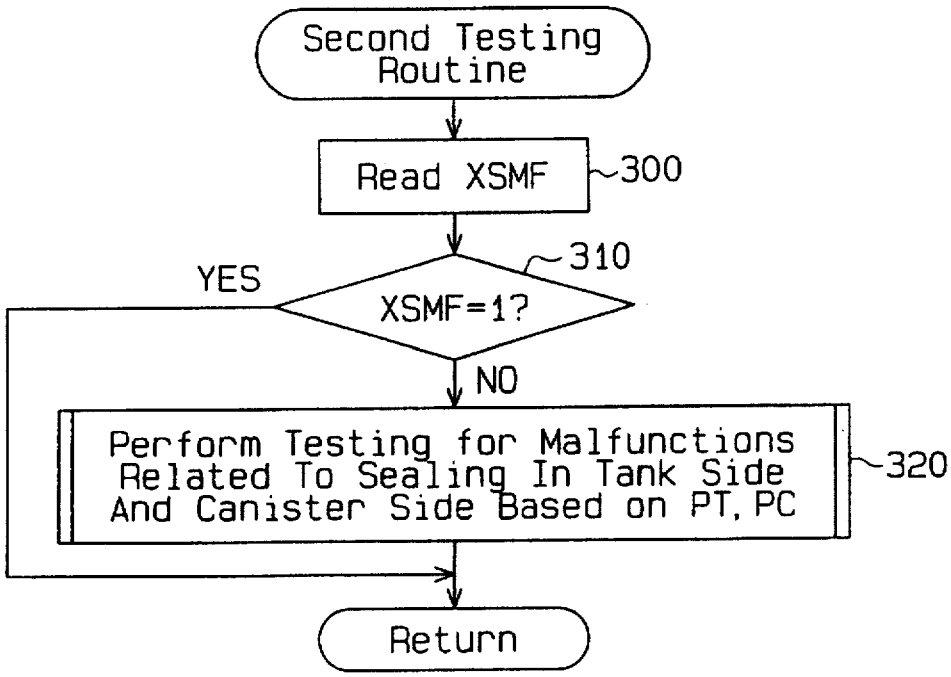
FIG. 7 shows a flow chart illustrating a "second testing routine"
Figure 8:
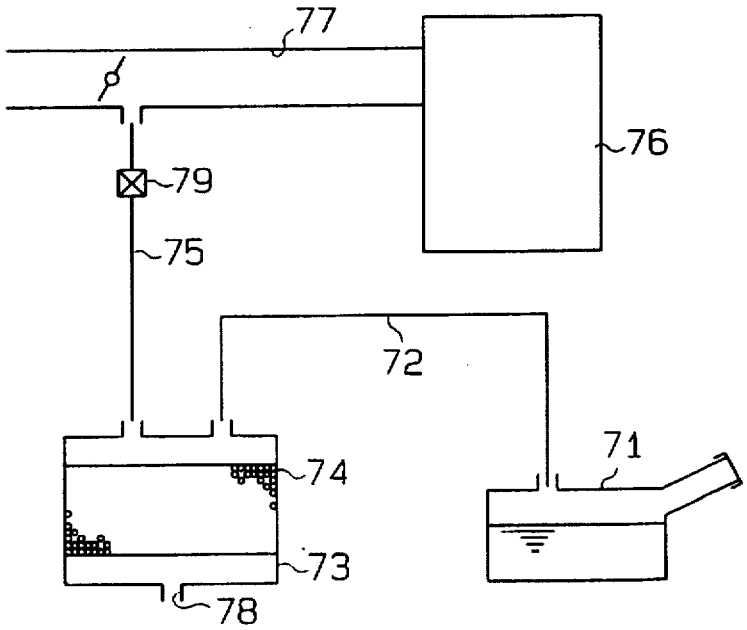
Fig. 8 (Prior Art)
FIG. 8 is a schematic view showing the structure of a prior art fuel vapor treating apparatus.
Figure 9:
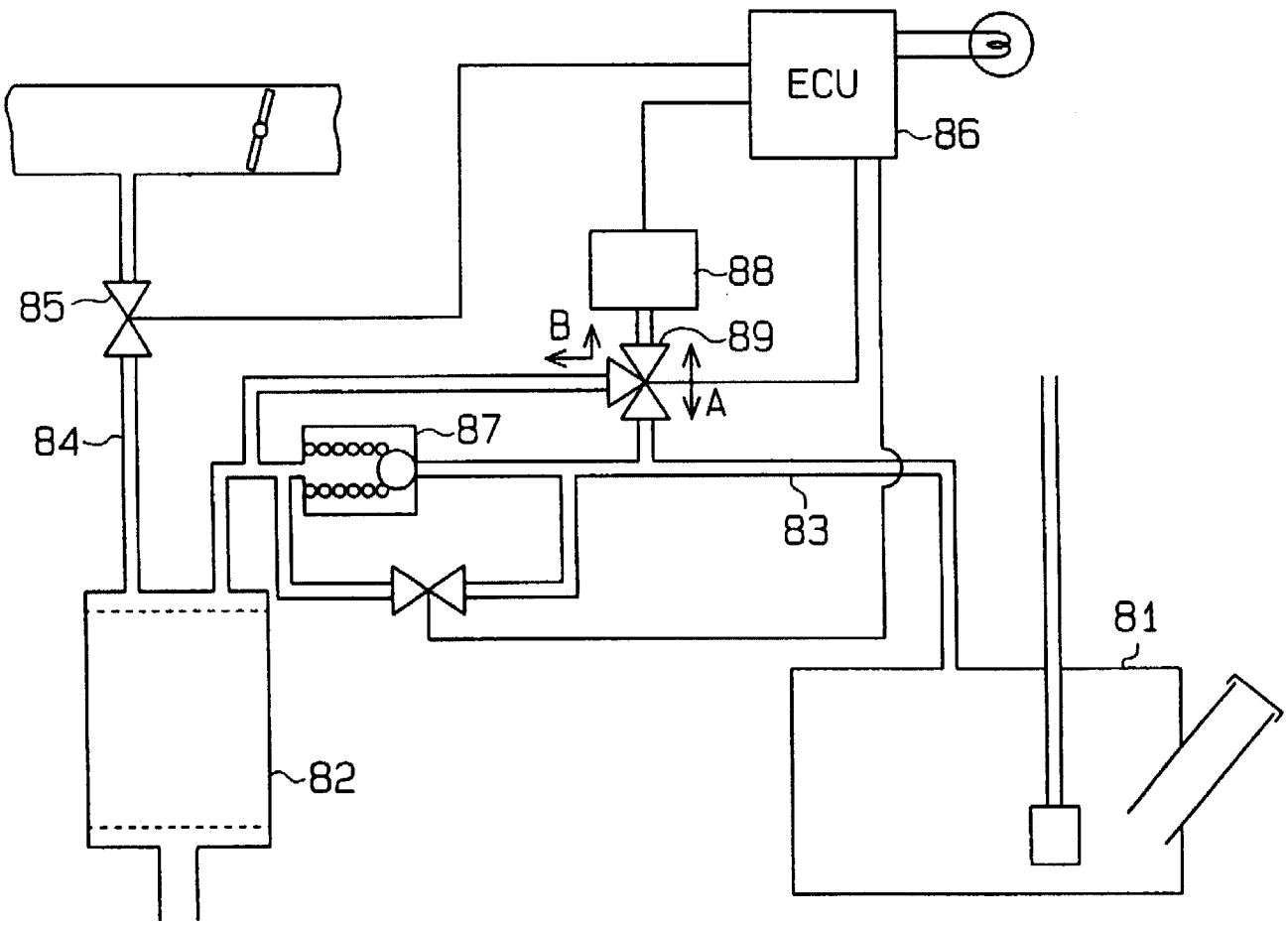
Fig. 9 (Prior Art)
FIG. 9 is a schematic view showing the structure of a prior art testing apparatus for a fuel vapor treating apparatus.

The testing of the treating apparatus is affected by the malfunction flag XSMF, which indicates the malfunctioning of the pressure sensor 41. A "second testing routine" used to perform testing of the treating apparatus for malfunctions related to its sealing is illustrated in the flowchart shown in FIG. 7. The ECU 51 executes this routine periodically once for every predetermined time period.

At step 300, the ECU 51 reads the malfunction flag XSMF. At step 310, the ECU 51 judges whether the malfunction flag XSMF is set at one. If the malfunction flag XSMF is set at zero, indicating that the pressure sensor 41 is functioning normally, the ECU 51 proceeds to step 320.

At step 320, the ECU 51 performs testing of the sealing of the tank side and the canister side by referring to the tank pressure PT and the canister pressure PC. The ECU 51 then temporarily terminates subsequent processing. The processing performed in step 320 will not be described in detail.

If the malfunction flag XSMF is confirmed to be set at one in step 310, indicating that the pressure sensor 41 is malfunctioning, the ECU 51 prohibits testing of the tank side and the canister side.

In this preferred embodiment, the testing of the sealing in the treating apparatus is performed when the pressure sensor 41 is functioning properly, and not when the sensor 41 is malfunctioning. This prevents erroneous testing of the sealing in the tank side and the canister side and thus enhances the reliability of the testing apparatus. That is, in a testing apparatus employing a testing method which tests the sealing of the treating apparatus by selectively detecting the tank pressure PT and the canister pressure PC with a pressure sensor 41 that detects relative pressure, the sealing in both the tank side and the canister side are tested appropriately. This is possible since the malfunctions of the pressure sensor 41 and the malfunctions of the treating apparatus are judged separately in an appropriate manner.

Although only one embodiment of the present invention has been described herein, it should be apparent to those skilled in the art that the present invention may be embodied in many other specific forms without departing from the spirit or scope of the invention. Particularly, it should be understood that the present invention may be modified as described below.

The pressure sensor 41 performs detection in the order of the canister side, the tank side, the canister side, and then the tank side during the ten seconds subsequent to the starting of the engine 8. However, instead of this order, the pressure sensor 41 may carry out detection in the order of the tank side, the canister side, the tank side, and then the canister side during the ten seconds.

The testing apparatus is disclosed as being employed in a fuel vapor treating apparatus that is provided with the purge control valve 22 in the purge line 21. However, testing may be performed on the pressure sensor 41 when used for a testing apparatus employed in a fuel vapor treating apparatus that does not have a purge control valve 22 in the purge line 21.

The canister 14 employs two control valves 16 and 18. However, the control valves 16, 18 may be omitted and replaced by a hole that is communicated with the atmosphere.

Therefore, the present embodiment is to be considered as illustrative and not restrictive and the invention is not to be limited to the details given herein, but may be modified within the scope of the appended claims.

What is claimed is:

1. A testing method for a fuel vapor treating apparatus, the treating apparatus including a canister for collecting fuel vapor generated in a fuel tank through a vapor line, wherein the fuel in the tank is supplied to an engine, a purge line for purging the collected fuel in the canister into an air intake passage of the engine by a negative intake pressure generated in the intake passage during operation of the engine, a vapor control valve connected to the vapor line between the tank and the canister for adjusting a flow of the fuel vapor passing from the tank to the canister, wherein the vapor control valve opens in accordance with a difference between the pressure of the tank and the pressure of the canister, the method comprising:

selectively detecting the pressure at a tank side of the vapor control valve and the pressure at a canister side of the vapor control valve by using pressure detecting means;

judging whether a malfunction has occurred related to a sealing of the tank side or related to a sealing of the canister side based on the detected pressure of the tank side and the detected pressure of the canister side;

alternately detecting the pressure of the tank side and the pressure of the canister side during a predetermined time period subsequent to a starting of the engine; and judging whether a malfunction of the pressure detecting means has occurred based on the detected pressures.

2. The testing method as set forth in claim 1, wherein the step of alternately detecting includes detecting relative pressure within a predetermined range between a upper limit value and a lower limit value based on atmospheric pressure, and transmitting the detected pressure value as a voltage within a predetermined dynamic range.

3. The testing method as set forth in claim 2, wherein the transmitted voltage is proportional to the detected pressure within the range between the upper limit value and the lower limit value, and transmitted voltage is a constant voltage when the detected pressure reaches the upper limit value and the lower limit value.

4. The testing method as set forth in claim 3, wherein said alternate detecting takes place in the order of the canister side, the tank side, the canister side and the tank side with predetermined intervals between each alternation.

5. The testing method as set forth in claim 1, wherein a malfunction of the pressure detecting means is judged finally when such malfunction is judged for plurality of consecutive times.

6. The testing method as set forth in claim 1 further comprising a warning step for warning of a malfunction when a malfunction is found.

7. The testing method as set forth in claim 1 further comprising a prohibiting step to prohibit testing related to the sealing of the tank side or the sealing of the canister side based on the pressure detected by the pressure detecting means when a malfunction of the pressure detecting means is found.

8. The testing method as set forth in claim 1, wherein the step of judging whether a malfunction of the pressure detecting means has occurred includes smoothening a pressure value detected by the pressure detecting means, and determining whether said smoothened pressure value is in a predetermined range to judge if a malfunction of the pressure detecting means has occurred.

9. A testing method for a fuel vapor treating apparatus, the treating apparatus including a canister for collecting fuel vapor generated in a fuel tank through a vapor line, wherein the fuel in the tank is supplied to an engine, a purge line for purging the collected fuel in the canister into an air intake passage of the engine by a negative intake pressure generated in the intake passage during operation of the engine, a vapor control valve connected to the vapor line between the tank and the canister for adjusting a flow of the fuel vapor passing from the tank to the canister, wherein the vapor control valve opens in accordance with a difference between the pressure of the tank and the pressure of the canister, the method comprising:

selectively detecting the pressure at a tank side of the vapor control valve and the pressure at a canister side of the vapor control valve by using pressure detecting means;

judging whether a malfunction has occurred related to a sealing of the tank side or related to a sealing of the canister side based on the detected pressure of the tank side and the detected pressure of the canister side;

alternately detecting the pressure of the tank side and the pressure of the canister side for first predetermined time periods by using said pressure detecting means during a second predetermined time period subsequent to a starting of the engine; and judging whether a malfunction of the pressure detecting means has occurred when the alternately detected pressure values remain outside of a predetermined range for a third predetermined time period.

10. The testing method as set forth in claim 9, wherein the step of alternately detecting includes detecting relative pressure within a predetermined range between a upper limit value and a lower limit value based on atmospheric pressure, and transmitting the detected pressure value as a voltage within a predetermined dynamic range.

11. The testing method as set forth in claim 10, wherein the transmitted voltage is proportional to the detected pressure within the range between the upper limit value and the lower limit value, and transmitted voltage is a constant voltage when the detected pressure reaches the upper limit value and the lower limit value.

12. The testing method as set forth in claim 11, wherein said alternate detecting takes place in the order of the canister side, the tank side, the canister side and the tank side with predetermined intervals between each alternation.

13. The testing method as set forth in claim 9, wherein a malfunction of the pressure detecting means is judged finally when such malfunction is judged for plurality of consecutive times.

14. The testing method as set forth in claim 9 further comprising a warning step for warning of a malfunction when a malfunction is found.

15. The testing method as set forth in claim 9 further comprising a prohibiting step to prohibit testing related to the sealing of the tank side or the sealing of the canister side based on the pressure detected by the pressure detecting means when a malfunction of the pressure detecting means is found.

16. The testing method as set forth in claim 9, wherein said second predetermined time period is ten seconds, wherein said third predetermined time period is seven seconds, and wherein said first predetermined time periods are each shorter than seven seconds.

17. The testing method as set forth in claim 12, wherein said second predetermined time period is ten seconds, wherein said third predetermined time period is seven seconds, and wherein said first predetermined time periods are each shorter than seven seconds.

* * * * *

UNITED STATES PATENT AND TRADEMARK OFFICE

CERTIFICATE OF CORRECTION

PATENT NO. : 5,726,354
DATED : March 10, 1998
INVENTOR(S) : Tokuhisa NOMURA, et al.

It is certified that error appears in the above-identified patent and that said Letters Patent is hereby corrected as shown below:

Column 2, line 48, after "method" insert --also--.

Column 2, line 52, after "method" insert --further--.

Column 2, line 55, after "method" insert --still further--.

Column 7, line 22," ("PTAD"0" to--("PTAD"--

Column 9, line 43, change "than" to --then--.

Column 11, line 7, change "second" to --seconds--.

Column 13, line 10, change "a upper" to --an upper--.

Column 14, line 18, change "a upper" to --an upper--.

Signed and Sealed this

Seventh Day of September, 1999

*Attest:*

Q. TODD DICKINSON

*Attesting Officer*

*Acting Commissioner of Patents and Trademarks*